United States Patent [19]

Haase

[11] Patent Number: 5,022,588

[45] Date of Patent: Jun. 11, 1991

[54] WATER TOY HAVING UMBRELLA SPRAY PATTERN

[76] Inventor: Gerald A. Haase, 1005 Country Club Rd., Lake Oswego, Oreg. 97034

[21] Appl. No.: 456,567

[22] Filed: Dec. 26, 1989

[51] Int. Cl.[5] ..... B05B 3/04

[52] U.S. Cl. ..... 239/211; 239/222.17; 239/382

[58] Field of Search ..... 239/211, 214, 222.11, 239/222.13, 222.17, 222.19, 222.21, 231, 232, 273, 275, 276, 279, 280, 280.5, 281, 289, 382, DIG. 1; 272/1 B

[56] References Cited

U.S. PATENT DOCUMENTS

| | | | |
|---|---|---|---|
| 469,848 | 3/1892 | Best | 239/279 |
| 3,873,026 | 3/1975 | Ochs | 272/1 B |
| 4,205,785 | 6/1980 | Stanley | 239/17 |
| 4,519,544 | 5/1985 | Szabo | 239/279 |
| 4,573,679 | 3/1986 | Janszen | 273/26 E |

*Primary Examiner*—Andres Kashnikow
*Assistant Examiner*—Karen B. Merritt
*Attorney, Agent, or Firm*—Chernoff, Vilhauer, McClung & Stenzel

[57] ABSTRACT

A water toy has a cylindrical deflector mounted on top of an upright hollow pipe that is rotatable about a vertical axis. Pressurized water introduced into the pipe is ejected from a nozzle fluidly interconnected with the pipe wupwardly onto the deflector along a plane which is offset from the deflector axis. The stream of water from the nozzle causes the deflector to rotate which in turn causes water to be thrown off of the periphery of the deflector into an umbrella pattern. If the nozzle has a concentrated spray pattern the umbrella spray is thin and covers a relatively large diameter, and if the nozzle has a fan-shaped spray pattern the umbrella spray is thicker and covers a relatively smaller diameter.

12 Claims, 3 Drawing Sheets

WATER TOY HAVING UMBRELLA SPRAY PATTERN

BACKGROUND OF THE INVENTION

This invention relates to a water toy, and in particular to a water toy which creates an umbrella-like spray of water.

Toys that generate a spray of water for play purposes are common in the prior art as a way for the user to cool off on a hot day. Typical of these devices are Janszen, U.S. Pat. No. 4,573,679 and Stanley, U.S. Pat. No. 4,205,785. All of these devices are deficient in two respects. First, in the prior art devices the spray is located at a single fixed distance above the ground. If the device is arranged to strike the body of a small child it would strike an adult on the legs. Conversely, if it were arranged to strike the body of an adult it would pass over the head of a child. Second, the shape of the spray pattern is fixed in the prior art devices which limits their play value.

The subject invention overcomes these shortcomings of the prior art devices by placing a closed-end hollow pipe that is fluidly connected to a source of pressurized water in an upright position. Mounted at one or more selected positions on the pipe is a cylindrical deflector that is rotatable about a vertical axis. In a preferred embodiment the deflector has the shape of a right circular cylinder, and has a peripheral cover with a napped texture similar to that of a paint roller.

Fluidly connected to the pipe below each deflector, is a supply tube having a nozzle located at its end which is oriented to direct a stream of water upwardly against the periphery of the deflector at an acute angle with respect to the deflector axis of rotation. In addition the stream of water is directed along a vertical plane which is offset from the axis of rotation. Thus, the stream of water causes the deflector to rotate which throws the water horizontally off of the deflector into an umbrella-shaped spray. A shut-off valve may be placed in the supply tube to permit the flow of water to the nozzle to be discontinued.

The spray nozzle can either be concentrated or fan-shaped. With the former the umbrella spray is thin and has a relatively large diameter, and with the latter the umbrella spray is fat and has a relatively small diameter.

If multiple deflectors are mounted on the pipe they can be positioned so that umbrellas can be located so that the spray is appropriate for different-sized users. In a preferred embodiment, the pipe is constructed from a plurality of short pieces of pipe joined together end to end by threaded collars, with each deflector being sandwiched between an adjacent pair of collars. This permits the position of the deflectors on the pipe to be varied, as well as allowing replacement of the deflectors if they become damaged.

Accordingly, it is a principal object of the subject invention to provide a water toy which creates an umbrella spray of water.

It is a further object of the subject invention to provide such a toy in which the umbrella spray can be made relatively thicker and thinner as desired.

It is a still further object of the subject invention to provide such a toy in which the umbrella spray can be provided at different positions above the ground.

It is a further object of the subject invention to provide such a toy in which there are multiple umbrella sprays.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figures 1, 2, 3:
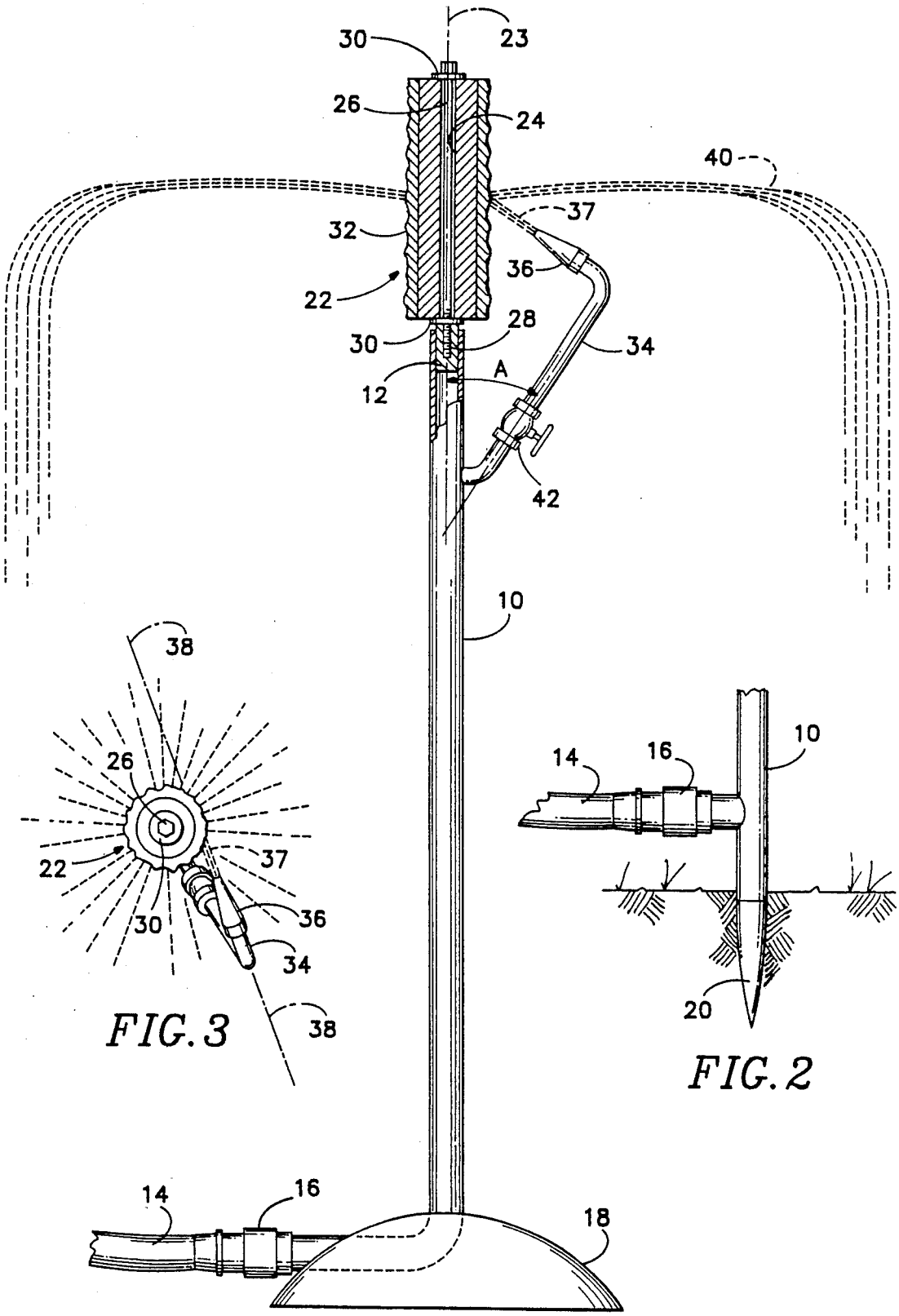
FIG. 1 is a side elevation view, partially broken away to show hidden detail, of a water toy embodying the features of the subject invention.
FIG. 2 is a fragmentary view of an alternate embodiment of a portion of the invention.
FIG. 3 is a plan view of the water toy of FIG. 1.

Referring to FIG. 1 of the drawings, the toy of the subject invention includes a hollow pipe 10 that is enclosed at its upper end by means of a plug 12 and is connected to a source of pressurized water at its lower end by means such as the hose 14 and fitting 16 shown in the drawings. The pipe is supported in an upright orientation by a stand 18 which sits on top of the ground, FIG. 1, or a spike 20 which is forced into the ground, FIG. 2. While the spike 20 is more stable and less likely to be tripped over, the stand 18 provides a more easily moved unit.

Mounted on the pipe 10 is a cylindrical deflector 22 which is rotatable about a vertical axis 23. In the embodiment illustrated in FIG. 1, the deflector has a hole 24 through it and is attached to the pipe by means of a bolt 26 which passes through the hole 24 and into a threaded opening 28 in the plug 12. Washers 30 located at each end of the deflector 22 act as thrust bearings. In the embodiment illustrated the deflector has a cover 32 which has a napped texture outer surface much like a paint roller.

Figure 5:
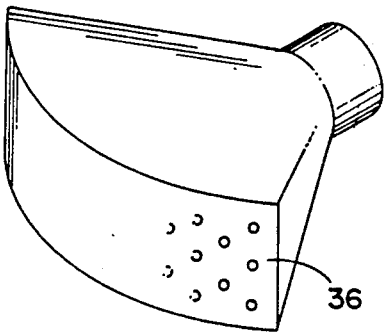
FIG. 5 is a perspective view of a second embodiment of a nozzle.
Figure 4:
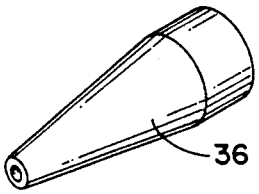
FIG. 4 is a perspective view of a first embodiment of a nozzle which is a portion of the invention.
Figure 9:
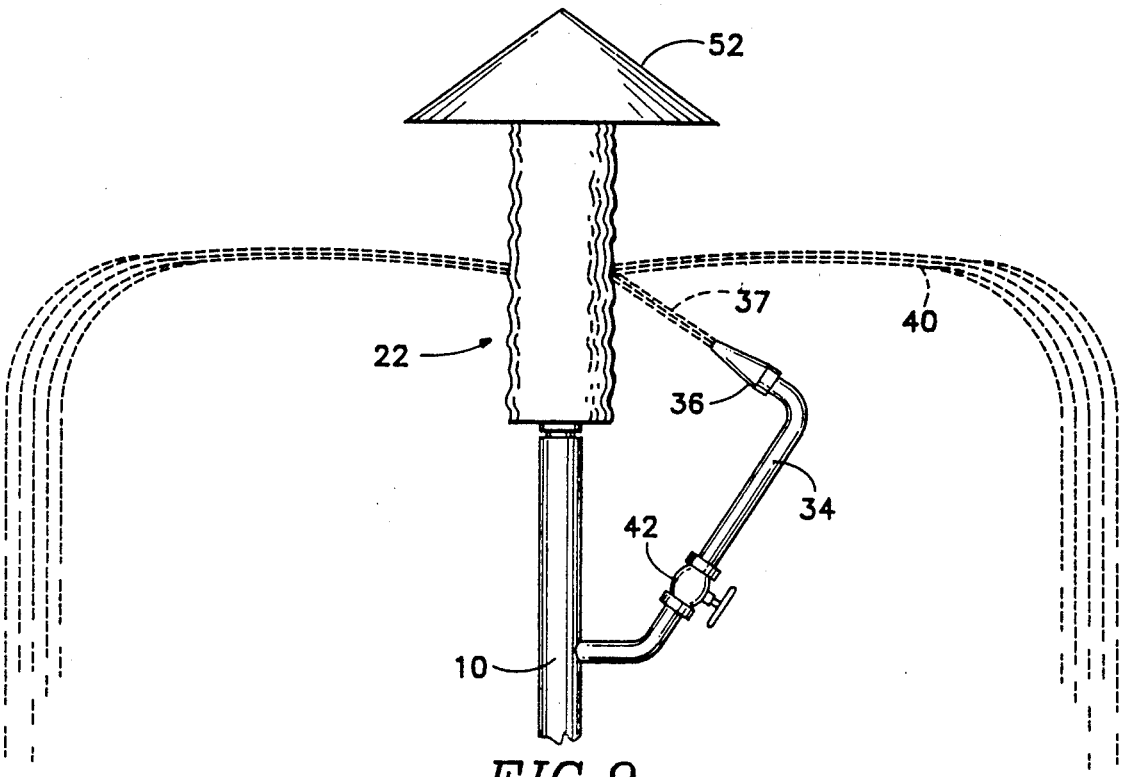
FIG. 9 is a fragmentary side elevation view of yet another embodiment of the invention.
Figure 6:
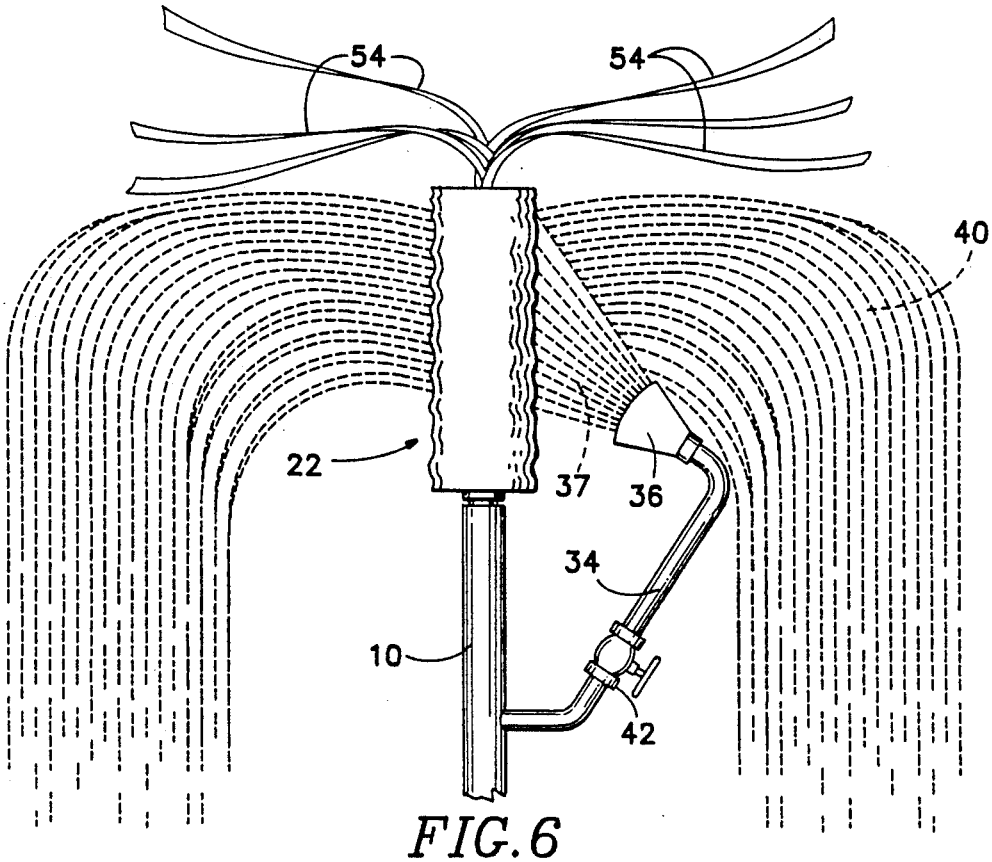
FIG. 6 is a fragmentary side elevation view of another embodiment of the invention.

A supply tube 34, which extends outwardly and upwardly from fluid connection with the pipe 10 immediately below the deflector, has a nozzle 36 mounted on its extremity which is aimed at the periphery of the deflector. The nozzle 36 is oriented such that the stream of water 37 sprayed out of it is angled upwardly at an acute angle A with respect to the rotational axis 23 of the deflector, FIG. 1, along a vertical plane 38 that does not pass through the axis 23, FIG. 3. Thus the stream of water 37 causes the deflector to rotate about its axis 23 and water from the nozzle is thrown outwardly from the deflector over 360 degrees to create an umbrella spray 40 of water. If the nozzle has a concentrated spray pattern, as shown in FIGS. 1, 4 and 9, the umbrella spray is relatively thin and covers a relatively large area. If the nozzle has a fan-shaped spray pattern, as shown in FIGS. 5 and 6, the umbrella spray is considerably fatter and covers a relatively smaller area. A shut-off valve 42 located in the supply tube 34 permits flow through the nozzle to be discontinued whenever desired.

Figure 7:
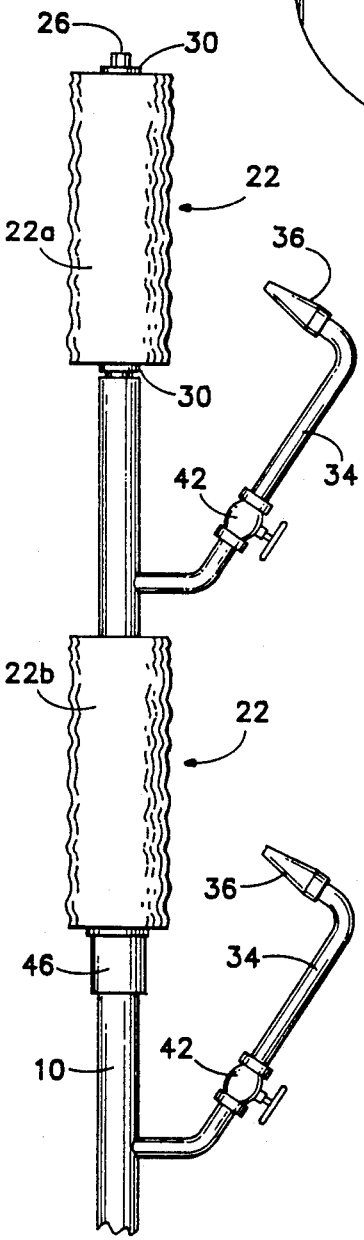
FIG. 7 is a fragmentary side elevation view of yet another embodiment of the invention.
Figure 8:
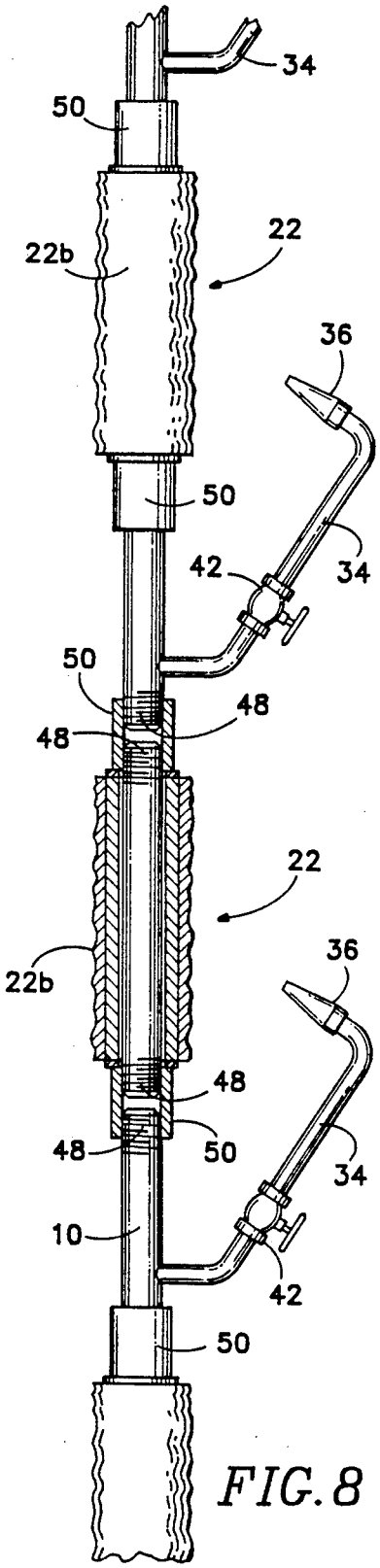
FIG. 8 is a side elevation view, partially broken away to show hidden detail, of still another embodiment of the invention.

Referring now to FIGS. 7 and 8, multiple deflectors 22 can be provided at spaced-apart locations along the pipe 10. The deflectors can either be operated simultaneously to provide multiple umbrella sprays of water, or a selected deflector can be operated alone to provide a single umbrella spray of water at a particular height above the ground. In the embodiment shown in FIG. 7, the top-most deflector 22*a* is mounted on top of the pipe 10 in the same manner that the deflector is mounted in the embodiment shown in FIG. 1. The lower deflectors 22*b* are annular with an inside diameter that is slightly larger than the diameter of the pipe 10. Thus, the lower deflectors 22*b* are simply placed over the pipe. In order to position the deflectors at the proper location along the pipe a collar 46 is attached to the pipe at the proper location. If desired, the supply tube 34 can be detachable from the pipe 10, such as by a threaded connection (not shown), to permit a lower deflector to be replaced.

In the embodiment illustrated in FIG. 8 the pipe 10 is divided into a plurality of pieces having threaded ends 48. The pieces are joined together end to end by means of collars 50 to make a continuous pipe. Each deflector then is placed on a piece of pipe which is slightly longer than the deflector so that when the collars 50 are installed on the ends 48, the deflector is sandwiched between the collars. The length of the pieces of pipe between deflectors is equal to the distance between deflectors. This embodiment permits any number of deflectors to be utilized with the deflectors being separated from one another by any desired distance. In addition, it provides for easy replacement of the deflectors. In order to create a less expensive version of this embodiment the collars could merely slip over the pipe and be glued to it rather than being attached to the pipe by threaded connections. This version does not provide the flexibility available with threaded collars, however, and does not permit replacement of the deflectors.

A final embodiment, which is not illustrated in the drawings, utilizes telescoping pipe sections between the deflectors. With this embodiment the height of the deflectors above the ground can easily be varied to make the spray suit a particular individual.

If desired, a decorative cover 52, FIG. 9, or streamers 54, FIG. 10, can be mounted on top of the uppermost deflector. The cover or streamers rotate with the deflector to provide an aesthetically attractive appearance.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A water toy comprising:

(a) an elongate, hollow, upright closed end column;

(b) means for connecting said column to a source of pressurized water;

(c) a cylindrical deflector having an outer surface that is substantially continuous mounted on said column, said deflector having a substantially vertical axis about which it is rotatable relative to said column; and (d) nozzle means for spraying water from said column against said outer surface of said deflector in a stream that is directed upwardly at an acute angle with respect to said axis along a vertical plane that does not pass through said axis.

2. The water toy of claim 1 wherein said deflector is a right circular cylinder.

3. The water toy of claim 2 wherein said deflector has a peripheral cover with a napped textured surface.

4. The water toy of claim 1 wherein said nozzle means comprises a nozzle having a fan-shaped spray pattern.

5. The water toy of claim 1 wherein said nozzle means comprises a nozzle having a concentrated spray pattern.

6. The water toy of claim 1 wherein there are multiple deflectors mounted at spaced-apart intervals on said column and separate nozzle means associated with each of said deflectors.

7. The water toy of claim 6, including a water shut-off valve operably associated with each of said nozzle means.

8. The water toy of claim 1 wherein said deflector is mounted on the upper extremity of said column.

9. The water toy of claim 6 wherein said column is a pipe and said deflectors are annular with an inner diameter which fits rotatably over said pipe.

10. The water toy of claim 9 wherein said column comprises a plurality of pieces which are interconnected end-to-end by collars and each deflector is sandwiched between an adjacent pair of said collars.

11. The water toy of claim 1 including a conical hat that fits on top of said deflector and rotates therewith.

12. The water toy of claim 1 including flexible elongate streamers which are attached to said deflector and rotate therewith.

* * * * *